US005356304A

United States Patent [19]

Colleran

[11] Patent Number: 5,356,304

[45] Date of Patent: Oct. 18, 1994

[54] SEALED CONNECTOR

[75] Inventor: Stephen A. Colleran, Lisle, Ill.

[73] Assignee: Molex Incorporated, Lisle, Ill.

[21] Appl. No.: 127,410

[22] Filed: Sep. 27, 1993

[51] Int. Cl.[5] ..... H01R 13/52

[52] U.S. Cl. ..... 439/205; 439/358; 439/275

[58] Field of Search ..... 439/205, 206, 274, 275, 439/357, 358, 589

[56] References Cited

U.S. PATENT DOCUMENTS 2,703,870 3/1955 Minto ..... 439/205
3,657,681 4/1972 Falkner ..... 439/205
4,395,085 7/1983 Inoue ..... 339/94 R
5,110,302 5/1992 Kobler ..... 439/357

*Primary Examiner*—Daniel W. Howell
*Attorney, Agent, or Firm*—A. A. Tirva

[57] ABSTRACT

A sealed electrical connector includes a housing having an interior cavity for sealingly receiving a mating connector. A latch arm engages the mating connector for holding the connectors in mated condition. A passageway communicates the interior cavity with the environment. A seal closes the passageway. The latch arm includes a release portion for biasing the seal and opening the passageway to release air entrapped in the cavity automatically as a function of mating the connectors.

10 Claims, 2 Drawing Sheets

SEALED CONNECTOR

FIELD OF THE INVENTION

This invention generally is directed to the art of electrical connectors and, particularly, to an environmentally sealed connector, such as a waterproof connector or the like.

BACKGROUND OF THE INVENTION

Environmentally sealed electrical connector assemblies generally include a pair of mating connector housings, such as male and female housings, wherein one of the housings mounts some form of "O" ring seal which is compressed against the housing of the mating connector to seal the mating interface between the housings. In addition, each matable connector housing mounts a plurality of terminals or contacts which are respectively terminated to a plurality of electrical wires. The wires and/or terminals project through sealing blocks which are effective to seal the interior of the connector housings from the environment in the area of the exiting wires. A typical sealed connector of this type is shown in U.S. Pat. No. 4,395,085 to Inoue, dated Jul. 26, 1983.

One of the problems which continues to plague such sealed connector assemblies concerns the buildup of pressure within the connector housings during mating of the connectors, as well as the creation of a vacuum during unmating of the connectors. In other words, with such sealed connectors, especially in larger connector assemblies, high mating and unmating forces often are experienced because of the pressure buildup due to air trapped within the connector housings during mating, as well as a vacuum created within the connector housings during the unmating process. Such pressure buildups within the connector housings also may cause leaks, because the pressure buildup may unseat or distort the seals.

The present invention is directed to solving these problems by providing a very simple release mechanism which creates a pressure relief to allow air to escape or enter the connector housings during the mating and unmating processes, the pressure relief being effected automatically in response to mating and unmating the connectors.

SUMMARY OF THE INVENTION

An object, therefore, of the invention is to provide a new and improved sealed electrical connector of the character described.

Generally, the sealed connector disclosed herein includes a housing having an interior cavity for sealingly receiving a mating connector. Latch means are provided for holding the connectors in mated condition. Passageway means communicate the interior cavity with the environment. Seal means sealingly close the passageway means.

The invention contemplates the provision of release means operatively associated between the latch means and the seal means, for biasing the seal means and opening the passageway means to release air entrapped in the cavity during mating of the connectors. The passageway means also is automatically opened during unmating of the connectors to allow air to enter the cavity.

More particularly, in the preferred embodiment, the latch means are provided by a latch arm having a first portion for latchingly engaging the mating connector and a second portion defining the release means. The housing is fabricated of molded plastic material, and the latch arm is integrally molded therewith. The latch arm is cantilevered from the housing at one end of the arm, and the opposite end of the arm is adapted to flex and bias the seal means during mating and unmating of the connectors.

As disclosed herein, the seal means is snugly fit within recess means of the housing. The passageway means communicates with the recess means, and the release means are adapted for biasing the seal means away from the side of the recess means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
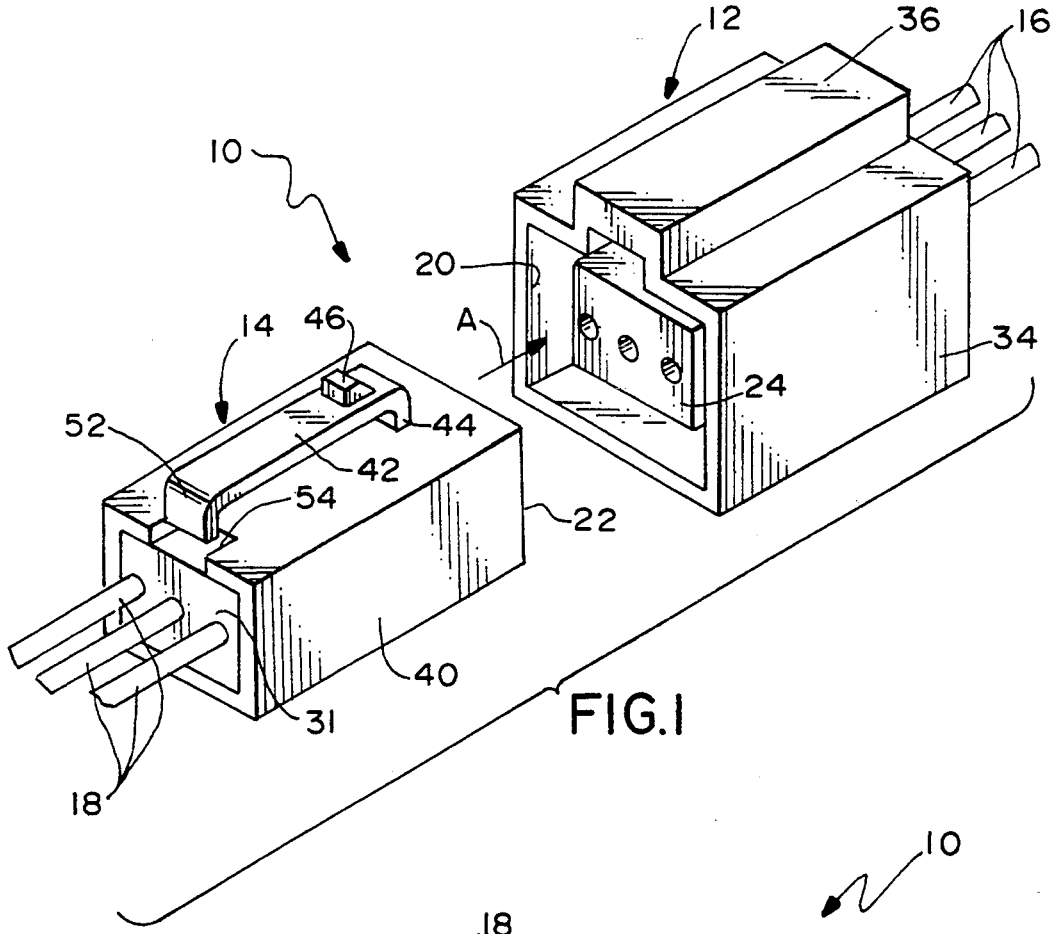
FIG. 1 is a perspective view of a connector assembly including a pair of mating connectors embodying the concepts of the invention, the connectors being in unmated condition.

Referring to the drawings in greater detail, and first to FIG. 1, the invention is embodied in a connector assembly, generally designated 10, which includes a female or receptacle connector, generally designated 12, for receiving a male or plug connector, generally designated 14. Connector 12 includes a plurality of terminals or contacts 13 (FIGS. 2 and 3) mounted therewithin and terminated to a plurality of electrical wires 16 projecting from the rear of the connector. Connector 14 similarly includes a plurality of terminals or contacts 15 (FIGS. 2 and 3) mounted therewithin and terminated to a plurality of electrical wires 18 projecting from the rear of the connector. Female connector 12 has a forward opening 20 for bodily receiving a forward end 22 of male connector 14 in a telescoping manner in the direction of arrow "A" (FIG. 1). However, female connector 12 has an interior plug portion 24 which is received in a receptacle 26 (FIG. 2) of male connector 14.

Figure 2:
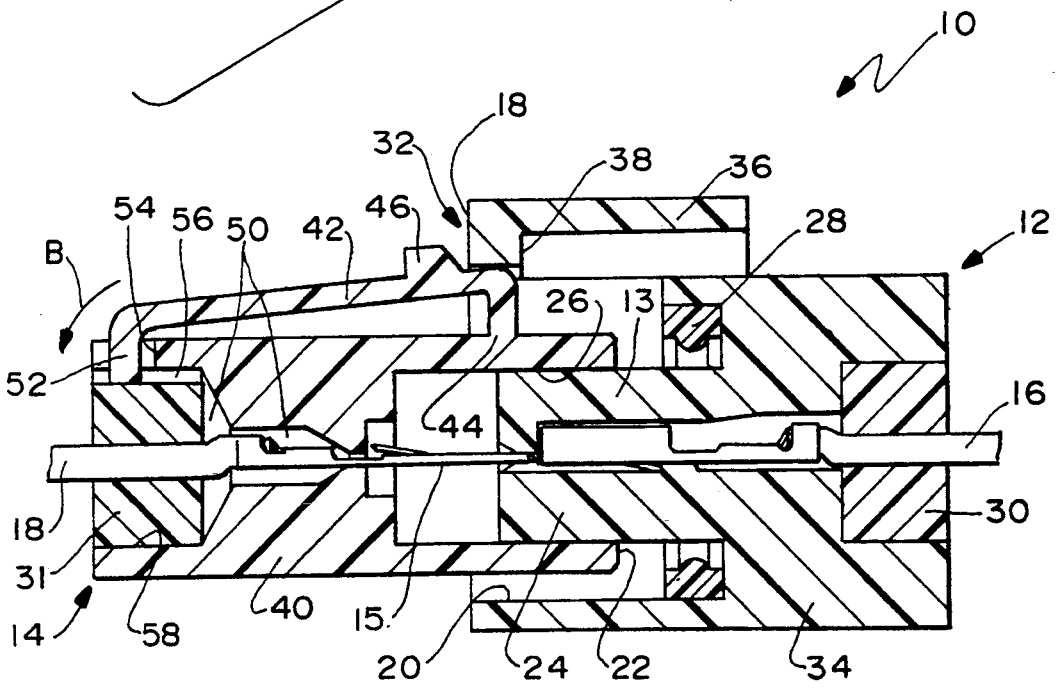
FIG. 2 is a vertical section through the connectors in partially mated condition, with the cantilevered latch arm being biased into engagement with the seal of one of the connectors.
Figure 3:
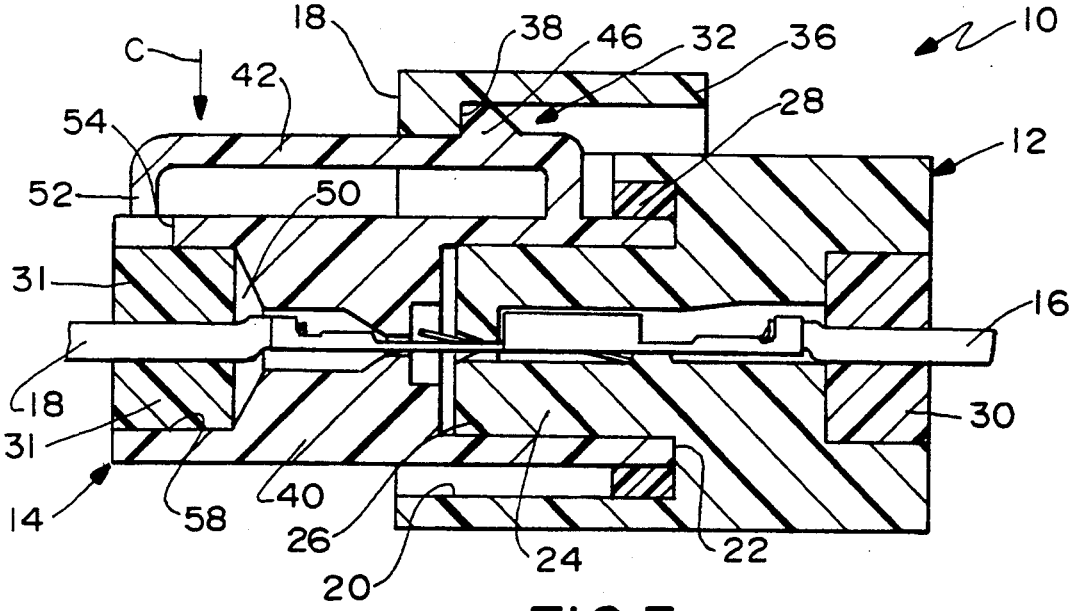
FIG. 3 is a view similar to that of FIG. 2, with the connectors in completely mated condition.

Referring to FIGS. 2 and 3 in conjunction with FIG. 1, connector 12 includes an interior seal 28 which may be an "O" ring-type and which is shown in FIG. 2 in an unstressed condition when connectors 12 and 14 are unmated. When the connectors are mated as shown in FIG. 3, forward end 22 of connector 14 moves within the bounds of seal 28, compressing the seal, whereby the mating interface between connectors 12 and 14 are sealed from the environment, including waterproofing of the connector assembly at the connector interface.

Both connectors 12 and 14 include a rear seal block 30 and 31, respectively, surrounding wires 16 and 18 where the wires exit from the connectors. As is known in the art, these blocks seal the rear or exiting ends of the connectors so that the interior cavities of the connectors, such as receptacle 28, are completely sealed from the surrounding environment, such as for waterproofing the connector assembly.

Latch means, generally designated 32 (FIGS. 2 and 3) are provided for holding connectors 12 and 14 in their mated condition as shown in FIG. 3. More particularly, connector 12 includes a dielectric housing 34 unitarily molded of plastic material and including a raised crown portion 36 at the top of the housing, with an interior, rearwardly facing latch shoulder 38 (FIGS. 2 and 3). Connector 14 includes a dielectric housing 40 unitarily molded of plastic material and including a cantilevered latch arm 42 integrally molded with the housing at one end 44 of the arm. The latch arm includes a latch boss 46 which has a chamfered or cam surface at the front thereof so that the latch arm is pivoted downwardly in the direction of arrow "B" (FIG. 2) during mating of the connectors. In other words, latch boss 46 engages a front surface 48 of upper crown portion 36 of housing 34 of connector 12 when connector 14 is mated with connector 12. This engagement causes the latch arm to pivot downwardly about end 44 of the arm, in the direction of arrow "B". Once the connectors are mated as shown in FIG. 3, latch boss 46 on latch arm 42 of connector 14 snaps into latching engagement behind shoulder 38 of connector 12.

Generally, release means are operatively associated between latch means 32 and seal 31 for biasing the seal and opening a passageway 50 which communicates the interior cavity of connector 14 with the environment.

More particularly, latch arm 42 has a leg or tab 52 on the distal end thereof and which passes through an opening 54 in housing 40 of connector 14. The leg is engageable with the side of seal block 31, as shown in FIG. 2. As connectors 12 and 14 are mated, during the mating process as shown in FIG. 2, latch arm 42 is forced downwardly in the direction of arrow "B" as described above. This forces leg 52 on the distal end of the arm downwardly through opening 54 into engagement with seal 31 and moves the seal to a relief condition to open a gap 56 between the seal and the upper walls of a recess 58 within which the seal is disposed. Therefore, receptacle or interior cavity 26 of connector 14 communicates through passageway 50 and gap 56 with the outside environment during mating of the connectors. This communication allows air in the mated connectors to escape to the outside thereof and prevents the buildup of pressure within the mated connectors, which otherwise would significantly increase the mating forces.

One additional benefit realized with the venting arrangement is that since air trapped inside the interior cavity of mated connectors is at atmospheric pressure, heat generated by mating electrical terminals may increase the air pressure, however, the final pressure will be lower than if the air trapped inside would have been initially higher than the atmospheric pressure. Sufficiently, high pressures generated inside the interior cavity could possibly blow out the seals.

As stated above, when connectors 12 and 14 are mated as shown in FIG. 3, latch boss 46 snaps behind shoulder 38. Latch arm 42, in turn, snaps back to its unbiased condition, opposite arrow "B", to the position shown in FIG. 3 wherein leg 52 no longer engages and biases against seal 31. The seal is fabricated of elastomeric material and resiliently returns to its sealing condition as shown in FIG. 3, thereby sealing the interior of the mated connectors from the environment.

Upon unmating of the connectors, pressure is applied to latch arm 42 in the direction of arrow "C" (FIG. 3) to move latch boss 46 out of latching engagement behind shoulder 38, whereupon the connectors can be unmated. However, during this unmating process, leg 52 also is forced back into engagement with the top of seal 31, to again form gap 56 to allow air to enter the interior of the mated connectors. This entering air prevents a vacuum from forming within the connectors and, thereby, reduces the unmating forces of the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a sealed electrical connector which includes a housing having an interior cavity for sealingly receiving a mating connector, latch means for holding the connectors in mated condition, passageway means communicating the interior cavity with the environment, and seal means for sealing and closing the passageway means, wherein the improvement comprises:

release means operatively associated between the latch means and the seal means for biasing the seal means and opening the passageway means to release air entrapped in the cavity during mating of the connectors.

2. In a sealed electrical connector as set forth in claim 1, wherein said latch means comprises a latch arm having a first portion for latchingly engaging the mating connector and a second portion defining said release means.

3. In a sealed electrical connector as set forth in claim 2, wherein said housing is fabricated of molded plastic material and said latch arm is integrally molded therewith.

4. In a sealed electrical connector as set forth in claim 3, wherein said latch arm comprises a cantilevered arm integrally molded with the housing at one end of the arm, with the opposite end of the arm being adapted to flex and bias the seal means during mating of the connectors.

5. In a sealed electrical connector as set forth in claim 4, wherein said seal means is snugly fit within recess means of the housing, said passageway means communicates with the recess means, and said release means is adapted for biasing the seal means away from a wall of the recess means.

6. In a sealed electrical connector which includes a housing having a cavity for sealingly receiving a mating connector, passageway means communicating the cavity with the environment, and seal means for sealingly closing the passageway means, wherein the improvement comprises:

release means for biasing the seal means and opening the passageway means to release air entrapped in the cavity automatically during mating of the connectors.

7. In a sealed electrical connector as set forth in claim 6, wherein said release means include a resilient arm on the connector housing and engageable with the mating connector during mating of the connectors, the arm being biased by the mating connector into engagement with the seal means.

8. In a sealed electrical connector as set forth in claim 7, wherein said housing is fabricated of molded plastic material, and said arm is integrally molded therewith.

9. In a sealed electrical connector as set forth in claim 7, wherein said arm comprises a cantilevered arm integrally molded with the housing at one end of the arm, with the opposite end of the arm being adapted to flex and bias the seal means during mating of the connectors.

10. In a sealed electrical connector as set forth in claim 6, wherein said seal means is snugly fit within recess means of the housing, said passageway means communicates with the recess means, and said release means is adapted for biasing the seal means away from a wall of the recess means.

* * * * *